US011607016B2

(12) United States Patent
Amsalem et al.

(10) Patent No.: US 11,607,016 B2
(45) Date of Patent: Mar. 21, 2023

(54) WEARABLE ELECTRONIC DEVICE ASSEMBLY

(71) Applicant: AeroScout Ltd., Ness-Ziona (IL)

(72) Inventors: Reuven Amsalem, Ness Ziona (IL); Alexey Kalmanovich, Rehovot (IL)

(73) Assignee: AEROSCOUT LTD, Ness Ziona (IL)

( * ) Notice: Subject to any disclaimer, the term of this patent is extended or adjusted under 35 U.S.C. 154(b) by 0 days.

(21) Appl. No.: 17/453,421

(22) Filed: Nov. 3, 2021

(65) Prior Publication Data

US 2022/0053893 A1 Feb. 24, 2022

Related U.S. Application Data

(63) Continuation of application No. 16/730,152, filed on Dec. 30, 2019, now Pat. No. 11,191,327.

(30) Foreign Application Priority Data

Jan. 21, 2019 (GB) ..... 1900798

(51) Int. Cl.
*A44C 5/14* (2006.01)
*A44B 11/26* (2006.01)
(Continued)

(52) U.S. Cl.
CPC ..... *A44C 5/14* (2013.01); *A44B 11/006* (2013.01); *A44B 11/22* (2013.01); *A44B 11/258* (2013.01);
(Continued)

(58) Field of Classification Search
CPC ..... A44B 11/006; A44B 11/266; A44B 11/22; A44B 11/2258; A44B 11/258;
(Continued)

(56) References Cited

U.S. PATENT DOCUMENTS 1,498,126 A * 6/1924 Smith ..... A44C 5/2071 24/578.15
1,543,399 A * 6/1925 Smith ..... A44C 5/2071 224/176
(Continued)

FOREIGN PATENT DOCUMENTS

WO 2017197896 A 11/2017

OTHER PUBLICATIONS

European Search Report dated May 7, 2020.

*Primary Examiner* — Robert Sandy
(74) *Attorney, Agent, or Firm* — Snell & Wilmer LLP

(57) ABSTRACT

A wearable electronic device assembly has a strap attached to the device for attaching the device to a wearer, and a connector for securing two overlapping end regions of the strap together. The connector has first and second parts configured to be secured together with the two overlapping end regions of the strap extending between them, to secure the two end regions together. The first part has a projection arranged to extend through or adjacent to the strap. The second part has a main body having an aperture to receive the projection of the first part, and a securement part movable with respect to the main body between a released position and a securement position. The projection is retained in the aperture to secure the first part of the connector to the second part of the connector.

10 Claims, 12 Drawing Sheets

(51) Int. Cl.

| | |
|---|---|
| ***A44B 11/25*** | (2006.01) |
| ***A44C 5/20*** | (2006.01) |
| ***A44B 11/22*** | (2006.01) |
| ***A44B 11/00*** | (2006.01) |

(52) U.S. Cl.
CPC ..... *A44B 11/2584* (2013.01); *A44B 11/263* (2013.01); *A44B 11/266* (2013.01); *A44C 5/2052* (2013.01); *A44C 5/2066* (2013.01); *A44C 5/2071* (2013.01)

(58) Field of Classification Search
CPC ..... A44B 11/2584; Y10T 24/4782; A44C 5/2052; A44C 5/2071; A44C 5/2066
See application file for complete search history.

(56) References Cited

U.S. PATENT DOCUMENTS

| | | | | |
|---|---|---|---|---|
| 4,221,063 | A * | 9/1980 | Charles | G09F 3/005 40/665 |
| 5,189,763 | A * | 3/1993 | Voumard | A44B 11/22 24/163 R |
| 5,226,809 | A | 7/1993 | Franco | |
| 9,314,072 | B2 | 4/2016 | Lee et al. | |
| 9,615,635 | B2 * | 4/2017 | Argiolas | A44C 5/185 |
| 10,039,350 | B2 * | 8/2018 | Lo | A44B 11/22 |
| 2018/0210400 | A1 | 7/2018 | Kaneko | |
| 2019/0029371 | A1 | 1/2019 | Cui et al. | |

* cited by examiner

WEARABLE ELECTRONIC DEVICE ASSEMBLY

FIELD

The present invention relates to a wearable electronic device assembly and in particular to a wearable device with a radio frequency (RF) tag or transponder device for a real-time location system.

The device preferably is wearable on a wrist of a user, but additionally or alternatively it may be worn on the ankle, or wherever convenient or suitable. The device may additionally or alternatively be worn by a non-human animal (e.g. a dog, a cat, or livestock), e.g. around the neck of the animal.

BACKGROUND

There is a need for the secure but releasable attachment of an electronic device (e.g. an RF tag or transponder) to a wearer (e.g. a vulnerable medical patient, elderly person, baby, or animal). The present invention seeks to provide an assembly which enables this.

DESCRIPTION OF DRAWINGS

FIGS. 1 and 2 show the wearable electronic device assembly with an assembled connector and a disassembled connector, respectively;

DETAILED DESCRIPTION

Figure 1:
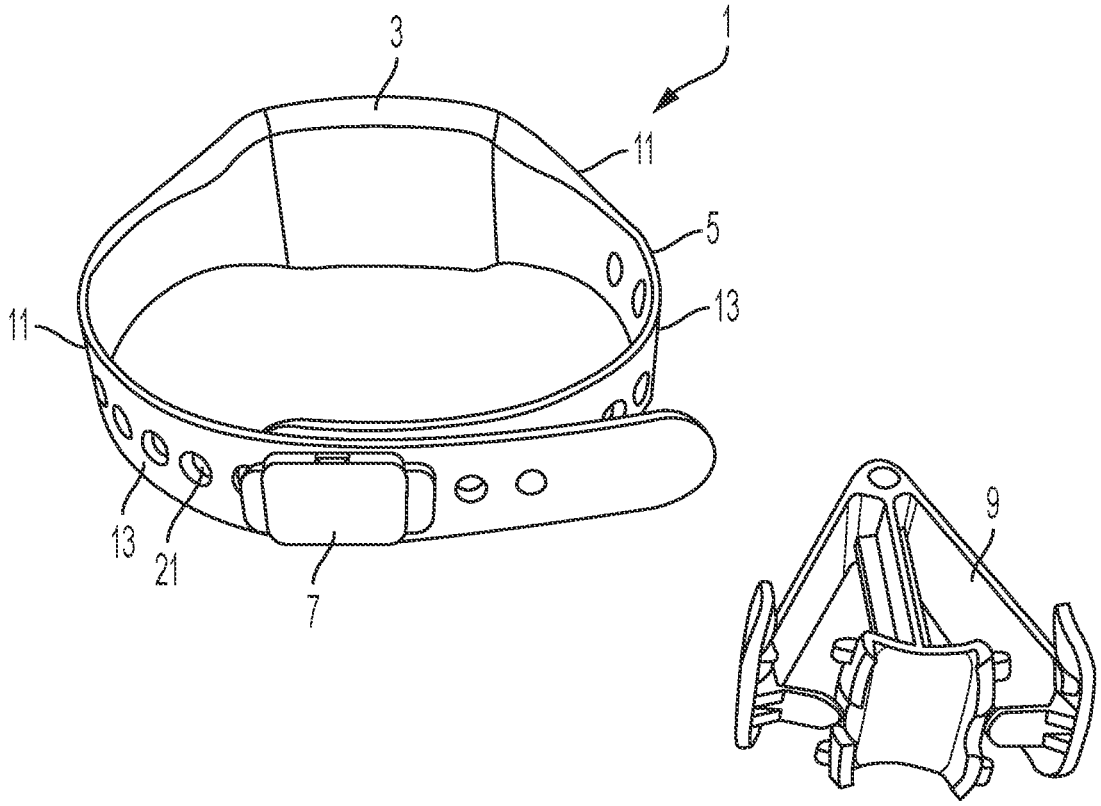
FIGS. 1 and 2 show a wearable electronic device assembly and tool, where
Figure 2:
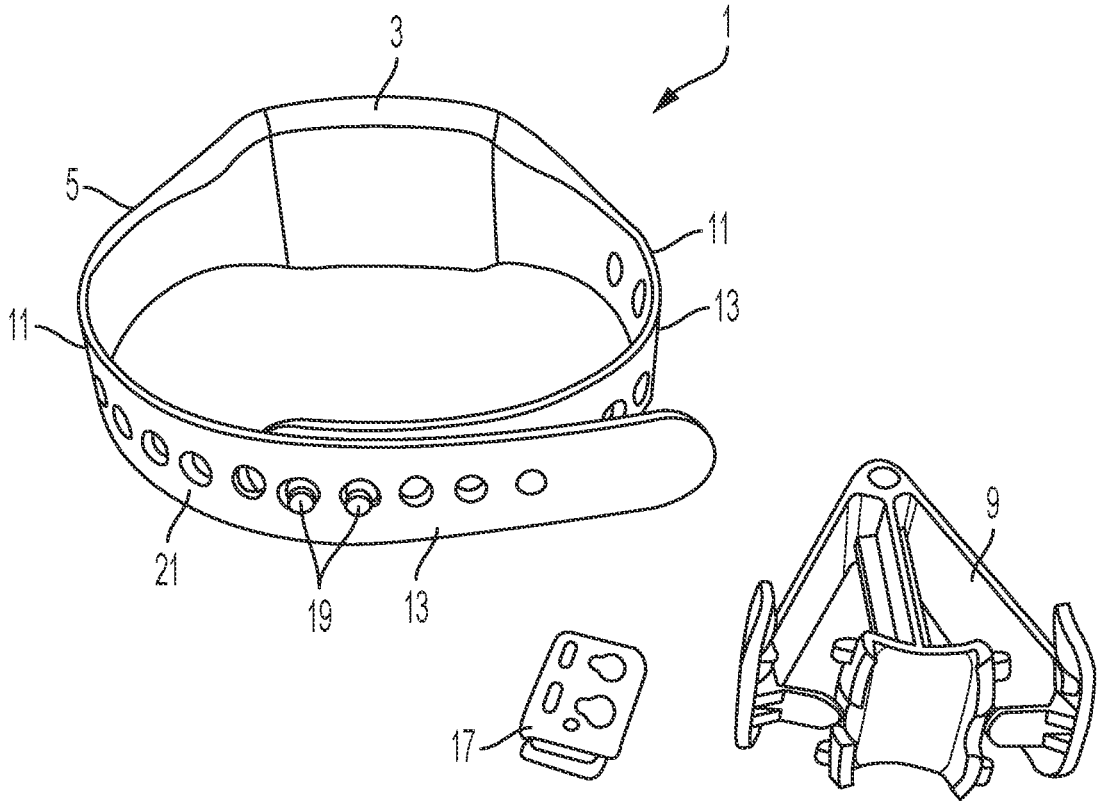
Figure 3:
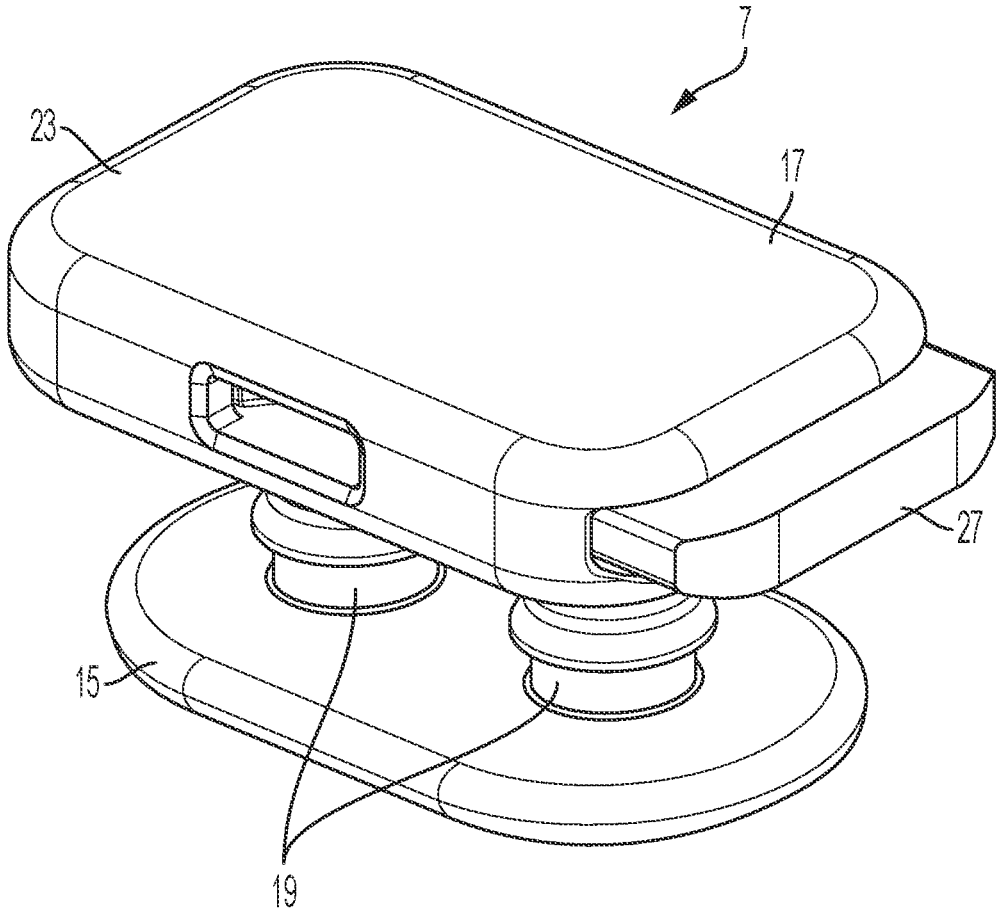
FIG. 3 is a front perspective view of the connector of the wearable device assembly.
Figure 4:
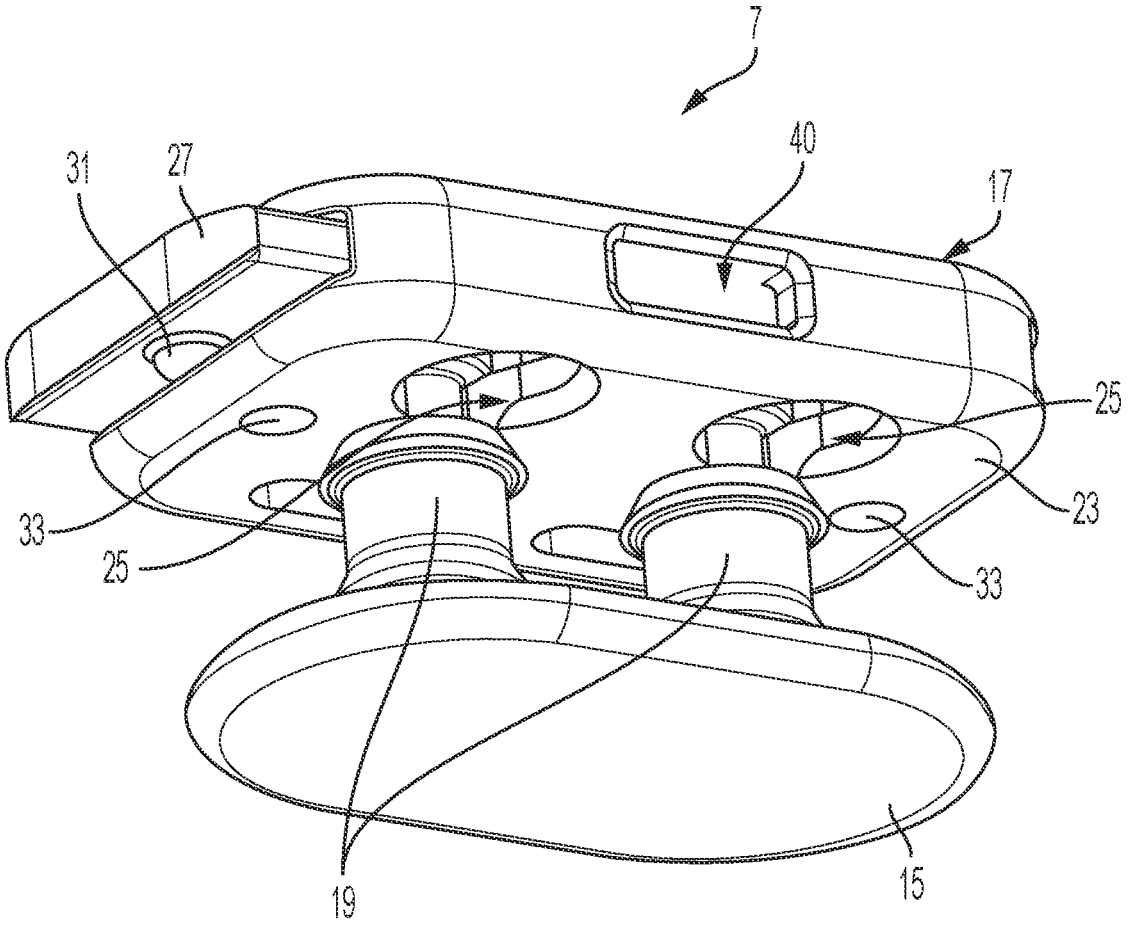
FIG. 4 is a rear perspective view of the connector of the wearable device assembly.
Figure 5:
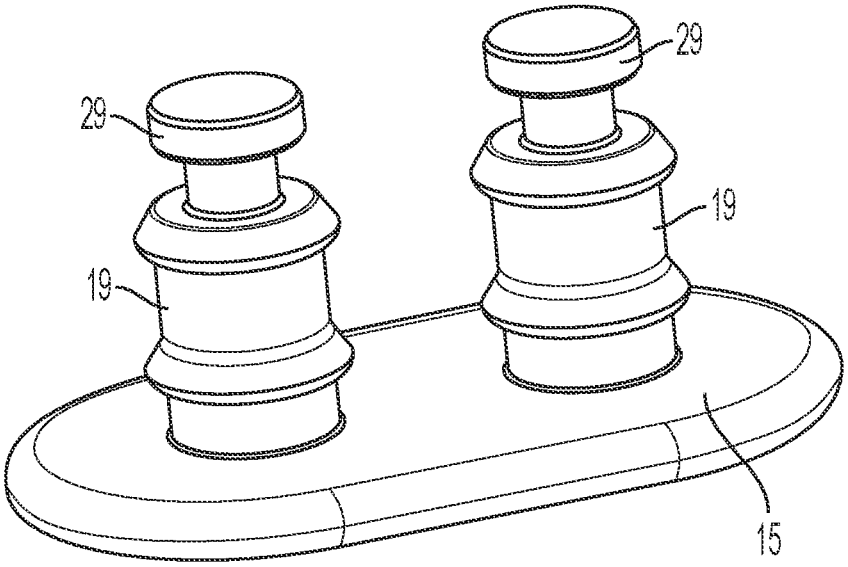
FIGS. 5 and 6 are rear perspective views of a first part and a second part of the connector, respectively.
Figure 6:
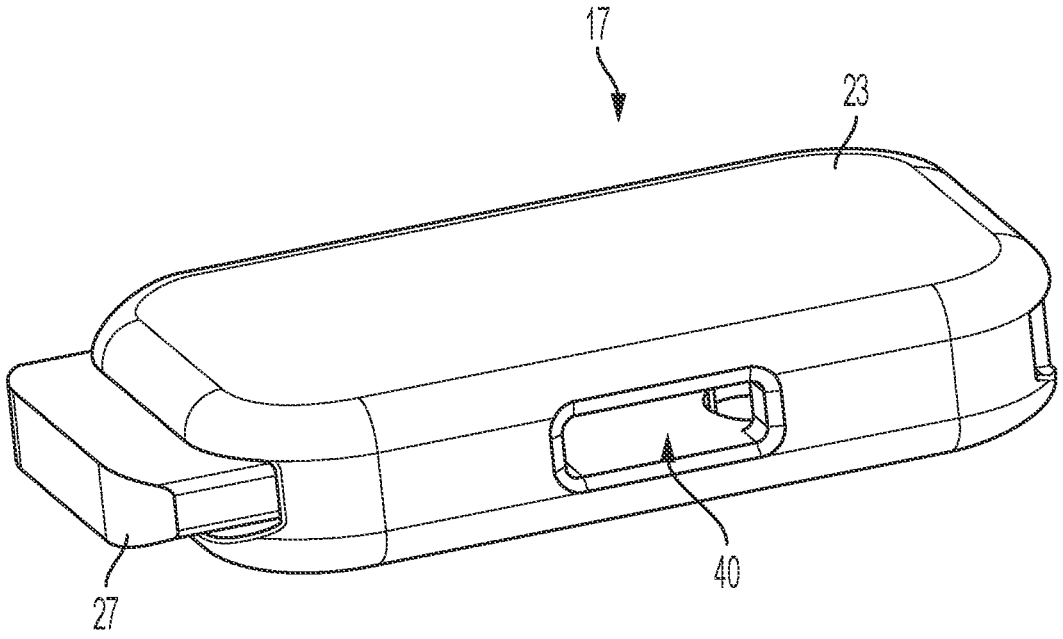

FIGS. 1 and 2 show an example of a wearable electronic device assembly 1. The wearable electronic device assembly 1 comprises an electronic device 3, a strap 5 attached to the device 3 for attaching the device 3 to a wearer (e.g. to the wearer's wrist), and a connector 7 (shown in more detail in FIGS. 3 to 9) for securing together two overlapping end regions of the strap 5. Also shown is a tool 9 (shown in more detail in FIGS. 10 to 12) for subsequently enabling the disconnection of the connector 7 from the end regions of the strap 5.

The electronic device 3 preferably comprises a radio frequency tag or transponder device for a real-time location system. Persons skilled in the art however shall recognize that the electronic device 3 could be a multi-functional electronic device, or another type of electronic device. Examples include computing devices, mobile telephone devices, watches, etc.

The strap 5 preferably comprises two strap portions 11, each strap portion 11 attached to a respective one of two opposite sides of the electronic device 3. The strap 5 preferably has two end regions 13. Each end region 13 may comprise all or most of the length of a respective strap portion 11. The two end regions 13 of the strap 5 are preferably arranged to be brought together in overlapping configuration, e.g. as illustrated in FIGS. 1 and 2.

The connector 7 preferably comprises a first part 15 and a second part 17, illustrated in more detail in FIGS. 3 to 9. The first part 15 of the connector 7 has one or more (two, in the illustrated example) projections 19 arranged to extend through or adjacent to the strap 5. Each end region 13 of the illustrated strap 5 preferably has a series of spaced holes 21 extending through the strap 5.

The projections 19 and the holes 21 are preferably arranged so as to allow the projections 19 to extend through selected holes 21 (and thus through or adjacent to the strap 5 itself), particular holes 21 being selected for a wearer according to size, so that the size of the loop (formed by the strap 5 and the electronic device 3), created when the end regions 13 are overlapped and connected together by the connector 7, is correct for securement on the wearer (e.g. around the wearer's wrist).

Persons skilled in the art shall recognize that, additionally or alternatively to holes 21 through the strap 5, there could be recesses or projections in or on the strap 5. If lateral recesses are used, for example, the projections 19 could extend through the recesses and adjacent to the strap 5.

The second part 17 of the connector 7 is then secured to the first part 15 of the connector 7 with the two overlapping end regions 13 of the strap 5 extending between them, thereby securing the two overlapping end regions 13 of the strap 5 together. In this way, the electronic device 3 is secured to the wearer.

FIGS. 3 to 9 illustrate the example connector 7 and its components in greater detail. The connector 7 preferably comprises a first part 15 and a second part 17. In the illustrated example, the first part 15 preferably comprises a pair of projections 19 arranged to extend through or adjacent to the strap 5 (e.g. through selected holes 21 in the strap 5).

The second part 17 of the illustrated connector 7 preferably comprises a main body 23 having a pair of apertures 25 to receive respective projections 19 therein. Additionally, the second part 17 may include a pair of securement parts 27 retained by, and movable (preferably by sliding) with respect to, the main body 23. In the illustrated embodiment, the securement parts 27 are preferably at least partly housed in the hollow main body 23.

Figure 7:
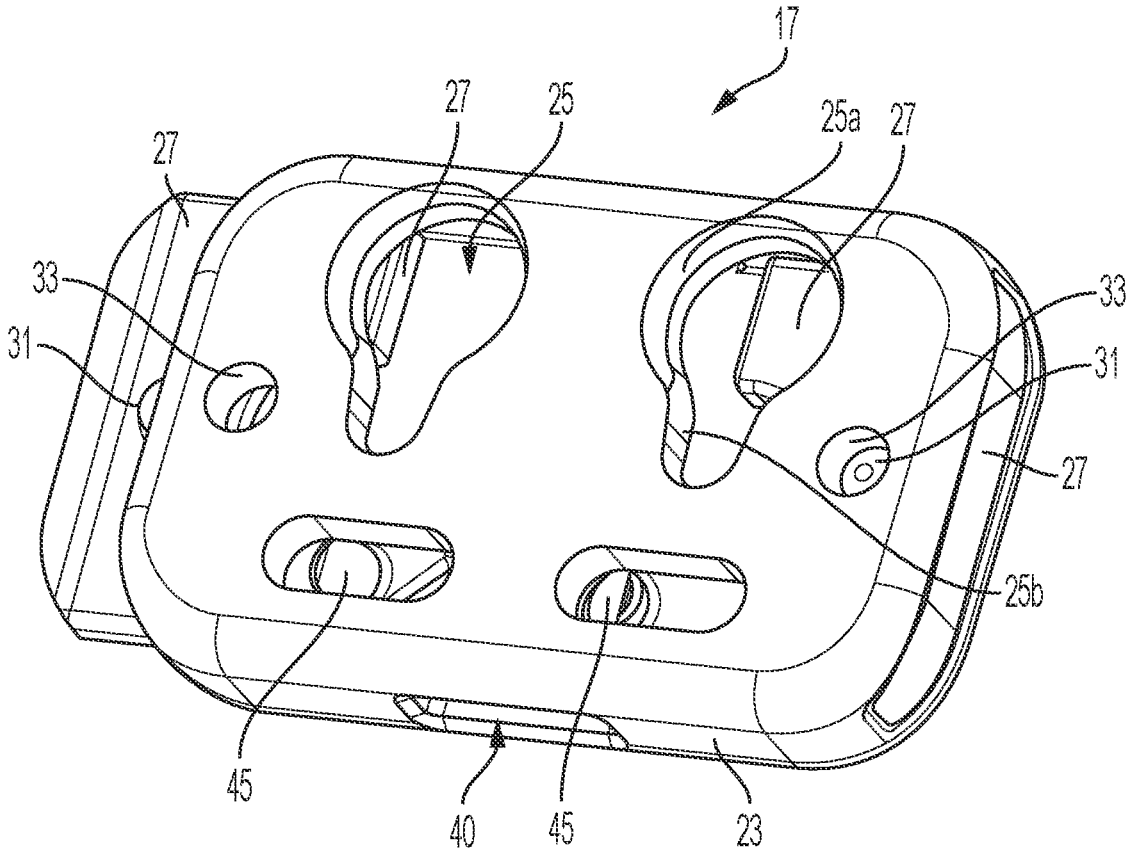
FIG. 7 is a bottom view of the second part of the connector.

Each projection 19 of the first part 15 of the connector 7 preferably includes an engagement protrusion 29. In the illustrated embodiment of the invention, each engagement protrusion 29 has the form of a circular flange; however, other shapes are possible. As shown in FIG. 7, each aperture 25 in the second part 17 of the connector 7 preferably has a relatively wide portion 25*a* and a relatively narrow portion 25*b* extending from the relatively narrow portion. In the illustrated embodiment of the invention, the relatively wide and narrow portions give the apertures 25 a key-hole type shape. The relatively wide portion 25*a* of each aperture 25 is preferably sized to allow the engagement protrusion 29 of its respective projection 19 to pass therethrough. The relatively narrow portion 25*b* of each aperture 25 is preferably sized to prevent the engagement protrusion 29 of its respective projection 19 to pass therethrough, thereby to retain the projection 19 in the relatively narrow portion 25*b* of the aperture 25 of the second part 17 of the connector 7, by engagement of the engagement protrusion 29 with the main body 23 of the second part 17 of the connector 7.

Figure 8:
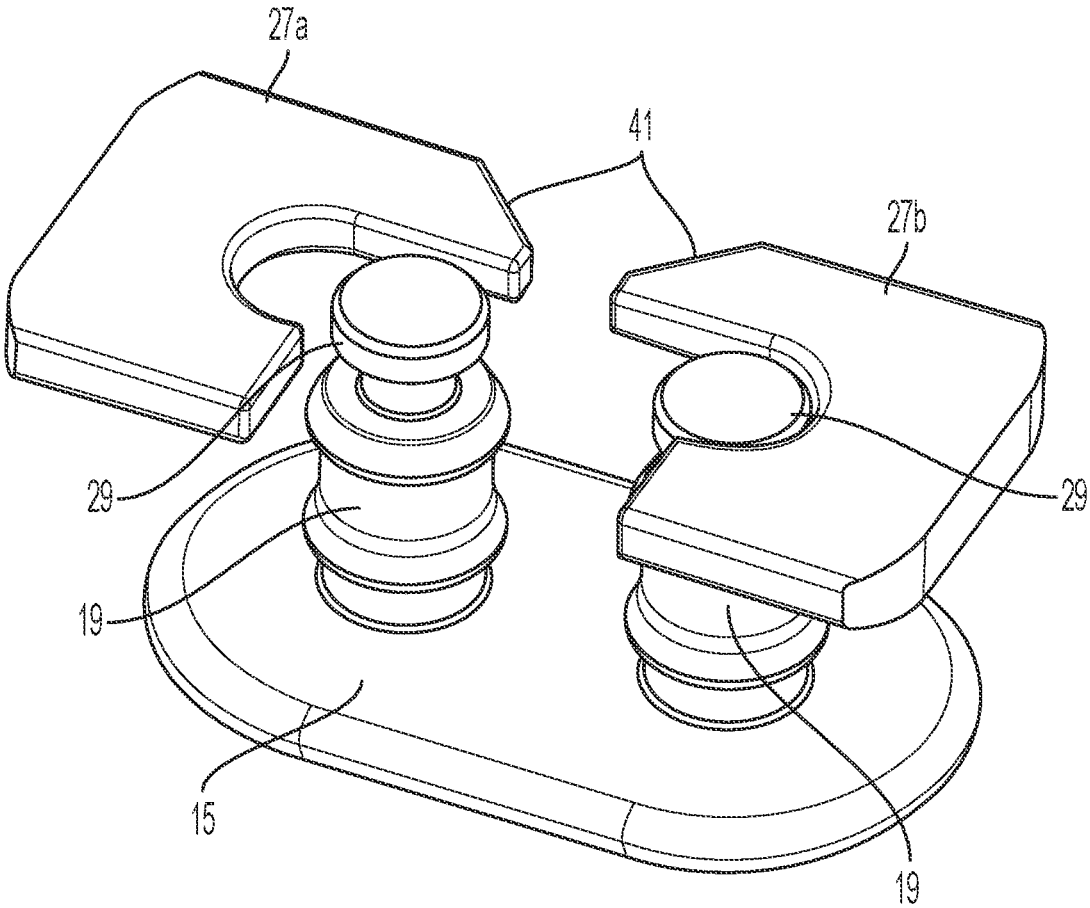
FIG. 8 is a partial view of the second part of the connector interacting with the first part of the connector.

Each securement part 27 of the second part 17 of the connector 7 is preferably retained by, and movable with respect to, the main body 23 between a released position and a securement position. In FIG. 8, the lefthand illustrated securement part 27*a* is shown in its released position, whereas the righthand illustrated securement part 27*b* is shown in its securement position. In the securement position, a securement part 27 preferably retains its respective projection 19 in the relatively narrow portion 25*b* of the aperture 25, by blocking lateral movement of the projection 19 in the aperture 25. In the illustrated example embodiment, the engagement protrusion 29 of a projection 19 engages with its respective securement part 27, to block such lateral movement of the projection 19.

Consequently, the first and second parts of the connector 7 are preferably secured together with the two overlapping end regions 13 of the strap 5 extending between them, by inserting the projections 19 of the first part 15 of the connector 7 into the relatively wide portions 25*a* of the apertures 25 and moving the second part 17 of the connector 7 laterally with respect to the first part 15 of the connector, to locate the projections 19 in the relatively narrow portions 25*b* of the apertures. Each securement part 27 may then be moved with respect to the main body 23 of the second part 17 of the connector 7 from its released position to its securement position to block any movement of the projections 19 from the relatively narrow portions 25*b* of the apertures 25 to the relatively wide portions 25*a* of the apertures. The first part 15 of the connector 7 is thereby secured to the second part 17 of the connector 7, and the two overlapping end regions 13 of the strap are thereby secured together.

Figure 9:
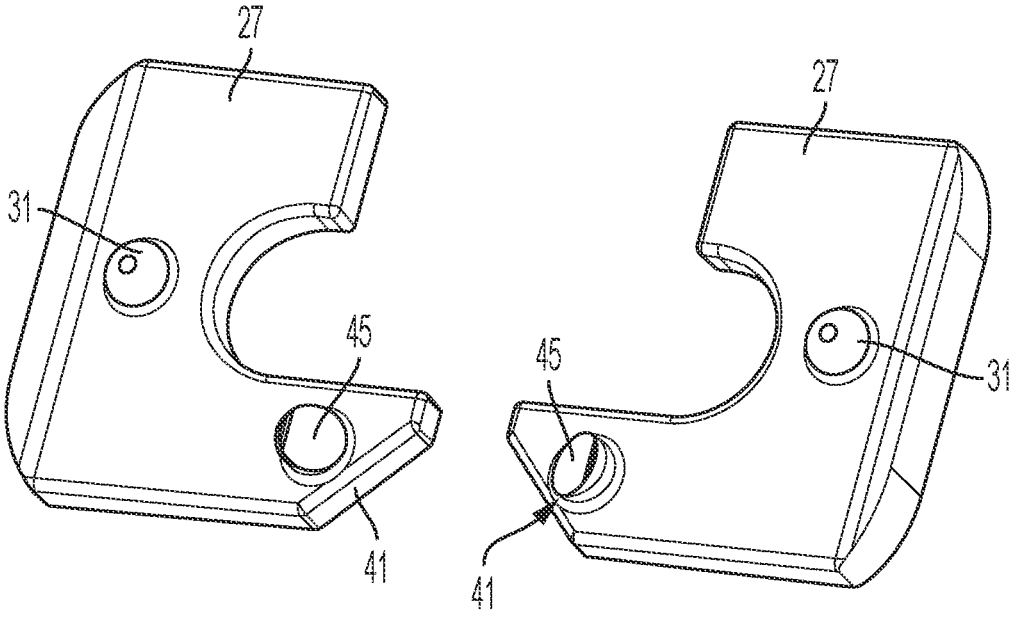
FIG. 9 is a bottom view of securement parts of the second part of the connector.

As shown in FIGS. 7 and 9, each securement part 27 preferably includes a protuberance 31 arranged to locate in a corresponding opening 33 in the main body 23 of the second part 17 of the connector 7 when the securement part 27 is in its securement position, thereby releasably securing the securement part 27 in its securement position. Persons skilled in the art shall recognize that the protuberance 31 could be on the main body 23, and the opening in the securement part 27.

Figure 10:
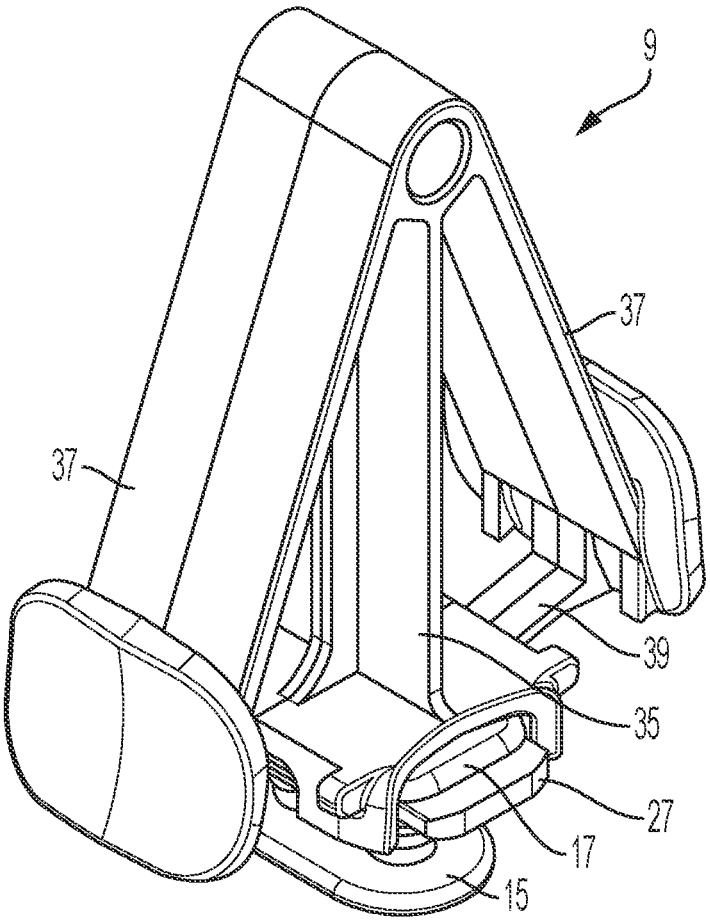
FIGS. 10 and 11 are first and second perspective views of a tool interacting with the connector, respectively.
Figure 11:
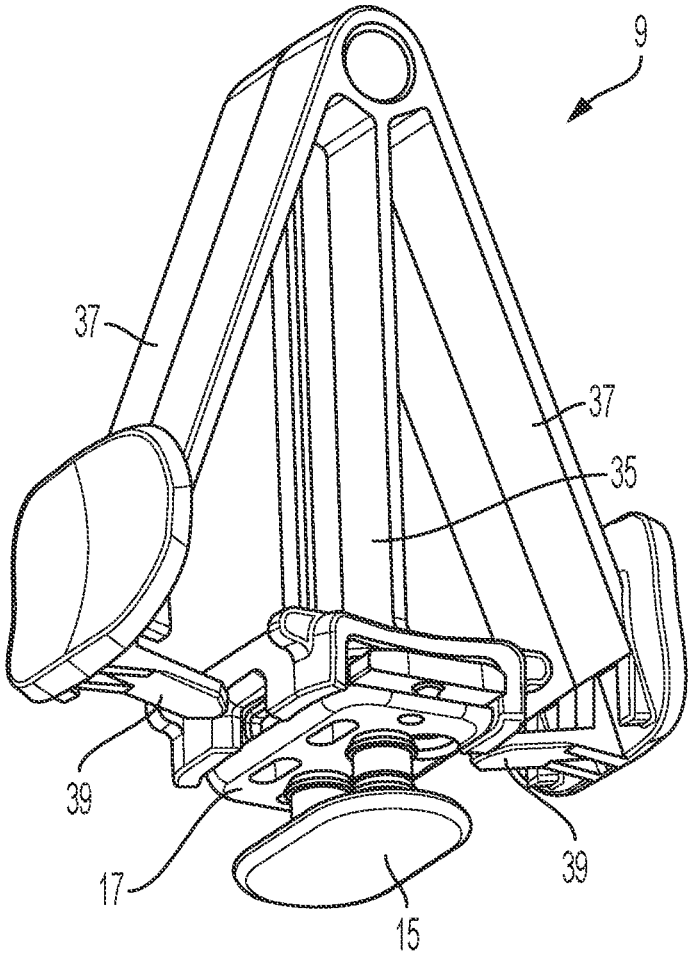
Figure 12:
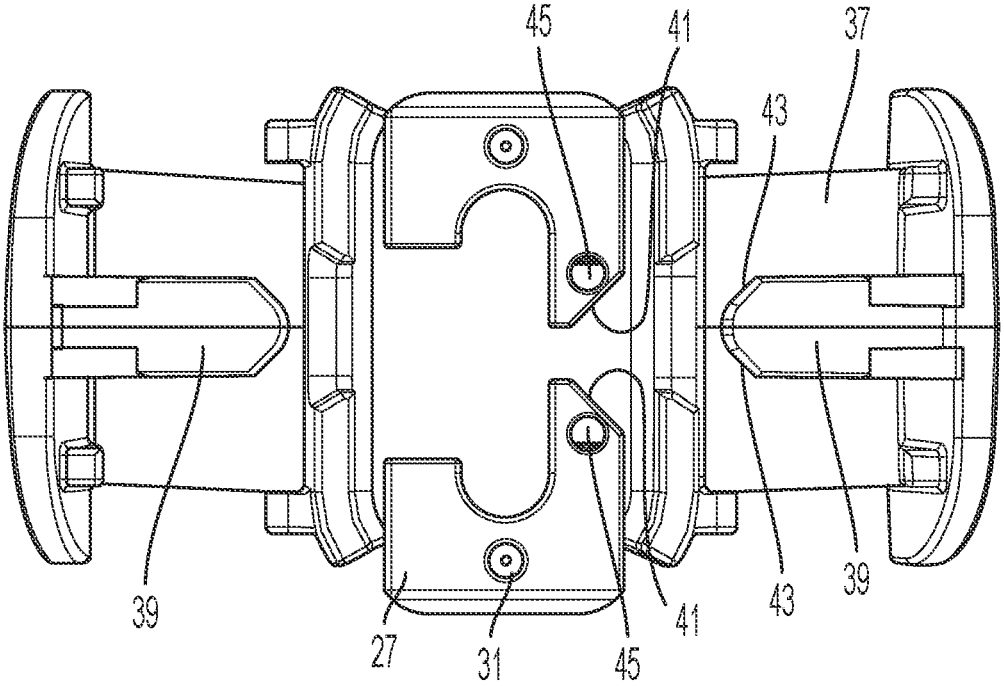
FIG. 12 is a partial bottom view of the tool interacting with the securement parts of the second part of the connector.

In order to move a securement part 27 from its securement position to its released position, thereby allowing the first and second parts of the connector 7 to be separated to allow the strap 5 to be opened and the electronic device 3 removed from the wearer, a particular tool 9 may be used. As illustrated in FIGS. 10 and 11, the example tool 9 preferably comprises a central arm 35 configured to temporarily fit onto the second part 17 of the connector 7, and two lateral arms 37 configured to be flexed or otherwise moved by the user such that a finger 39 projecting from each lateral arm 37 may be inserted through an opening 40 into the main body 23 of the second part 17 of the connector 7. As shown in FIGS. 8, 9 and 12, each securement part 27 preferably includes a first cam surface 41. As shown in FIG. 12, each finger 39 of the tool 9 may include cam surfaces 43, such that when, in use, the cam surfaces 43 of the fingers 39 are pushed against the first cam surfaces 41 of the securement parts 27, the securement parts 27 are moved from their securement positions to their released positions. Additionally or alternatively, the securement parts 27 may include second cam surfaces 45 which may be contacted and pushed by another tool, e.g. an end of a paper clip or the like, to move the securement parts 27 from their securement positions to their released positions.

Persons skilled in the art shall recognize that the optional requirement to use a specific tool, or at least a paper clip or the like as a tool, provides an additional level of security of attachment of the electronic device to the wearer, to prevent unsafe or unauthorized removal of the device, while allowing easy removal by use of the specific tool, or by a certain minimum level of understanding, manual dexterity and visual acuity by use of a paper clip or the like.

It will be understood that the above description and the drawings are of a particular example embodiment of the invention, but that other embodiments of the invention are included in the scope of the claims.

The invention claimed is:

1. A wearable electronic device assembly, comprising:

a connector comprising first and second parts configured to be secured together with two overlapping end regions of a strap attached to an electronic device extending between them, thereby to secure the two overlapping end regions of the strap together;

wherein the first part of the connector comprises a projection arranged to extend through or adjacent to the strap; and the second part of the connector comprises a main body having an aperture to receive the projection of the first part therein, and a securement part retained by and movable with respect to the main body between a released position and a securement position;

wherein the projection has an engagement protrusion configured to engage with the main body or the securement part when the securement part is in the securement position, to retain the projection in the aperture of the second part of the connector.

2. An assembly according to claim 1, wherein the engagement protrusion is releasable from its engagement with the at least one of the main body or the securement part when the securement part is in the released position.

3. An assembly according to claim 1, wherein the securement part is slidable with respect to the main body of the second part of the connector.

4. An assembly according to claim 1, wherein the securement part is releasably securable in the securement position.

5. An assembly according to claim 4, wherein the securement part is releasably securable in the securement position by means of a protuberance on one of the securement part and the main body catching in an opening in the other of the main body and the securement part.

6. An assembly according to claim 1, wherein the aperture has a wide portion sized to allow the engagement protrusion of the projection to pass therethrough, and a narrow portion extending from the relatively wide portion, the narrow portion sized to prevent the engagement protrusion of the projection passing therethrough thereby to retain the projection in the narrow portion of the aperture of the second part of the connector.

7. An assembly according to claim 6, wherein the securement part retains the projection in the narrow portion of the aperture when the securement part is in the securement position.

8. An assembly according to claim 6, wherein the securement part substantially blocks movement of the projection in the aperture when the securement part is in the securement position.

9. An assembly according to claim 1, wherein at least one of the end regions of the strap have a series of spaced holes extending therethrough.

10. An assembly according to claim 1, wherein the securement part includes at least one cam surface configured to enable the securement part to be moved from the securement position to the released position.

* * * * *